US011086252B1

(12) United States Patent
Tanaka

(10) Patent No.: US 11,086,252 B1
(45) Date of Patent: Aug. 10, 2021

(54) DEVELOPING DEVICE AND IMAGE FORMING APPARATUS HAVING HOUSING INCLUDING A METAL PORTION

(71) Applicant: FUJIFILM Business Innovation Corp., Tokyo (JP)

(72) Inventor: Arichika Tanaka, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/943,500

(22) Filed: Jul. 30, 2020

(30) Foreign Application Priority Data

Feb. 28, 2020 (JP) ..... JP2020-032882

(51) Int. Cl.
*G03G 15/08* (2006.01)

(52) U.S. Cl.
CPC ..... *G03G 15/0865* (2013.01); *G03G 15/0808* (2013.01)

(58) Field of Classification Search
USPC ..... 399/254
See application file for complete search history.

(56) References Cited

U.S. PATENT DOCUMENTS 6,731,893 B2 5/2004 Okoshi
2005/0105921 A1* 5/2005 Yoshizuka ..... G03G 15/0173 399/12
2009/0080932 A1* 3/2009 Mimura ..... G03G 15/0865 399/109
2013/0022368 A1* 1/2013 Takarada ..... B29C 45/0001 399/110
2015/0016829 A1* 1/2015 Watanabe ..... G03G 21/181 399/27

FOREIGN PATENT DOCUMENTS

JP 3982212 B2 9/2007

* cited by examiner

*Primary Examiner* — Quana Grainger
(74) *Attorney, Agent, or Firm* — Sughrue Mion, PLLC

(57) ABSTRACT

A developing device includes a housing that includes a container portion, a rotating portion, and a developing roller. The container portion has a metal formed portion formed of metal and contains developer. The rotating portion is to be rotated so as to transport the developer contained in the container portion in a longitudinal direction. The developing roller holds the developer transported by the rotating portion. The metal formed portion is disposed in at least part of the container portion in a region superposed on a developer holding region of the developing roller in the longitudinal direction.

20 Claims, 9 Drawing Sheets

DEVELOPING DEVICE AND IMAGE FORMING APPARATUS HAVING HOUSING INCLUDING A METAL PORTION

CROSS-REFERENCE TO RELATED APPLICATIONS

This application is based on and claims priority under 35 USC 119 from Japanese Patent Application No. 2020-032882 filed Feb. 28, 2020.

BACKGROUND

(i) Technical Field

The present disclosure relates to a developing device and an image forming apparatus.

(ii) Related Art

A know developing device is described in Japanese Patent No. 3982212.

Japanese Patent No. 3982212 (for example, paragraph and FIG. 10) describes a developing device in which a housing is separated in an up-down direction into two parts, that is, an upper housing and a lower housing, the developing device is assembled by joining the two separated parts together, and the upper housing and the lower housing are formed of synthetic resin.

SUMMARY

Aspects of non-limiting embodiments of the present disclosure relate to providing of a developing device and an image forming apparatus the stiffness of which may be improved compared to the case where a housing does not have a structure in which at least part of a container portion of the housing in a region superposed on a developer holding region of a developing roller in a longitudinal direction is formed of metal.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a developing device that includes a housing that includes a container portion, a rotating portion, and a developing roller. The container portion has a metal formed portion formed of metal and contains developer. The rotating portion is to be rotated so as to transport the developer contained in the container portion in a longitudinal direction. The developing roller holds the developer transported by the rotating portion. The metal formed portion is disposed in at least part of the container portion in a region superposed on a developer holding region of the developing roller in the longitudinal direction.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure will be described below with reference to the drawings.

First Exemplary Embodiment

Figure 1:
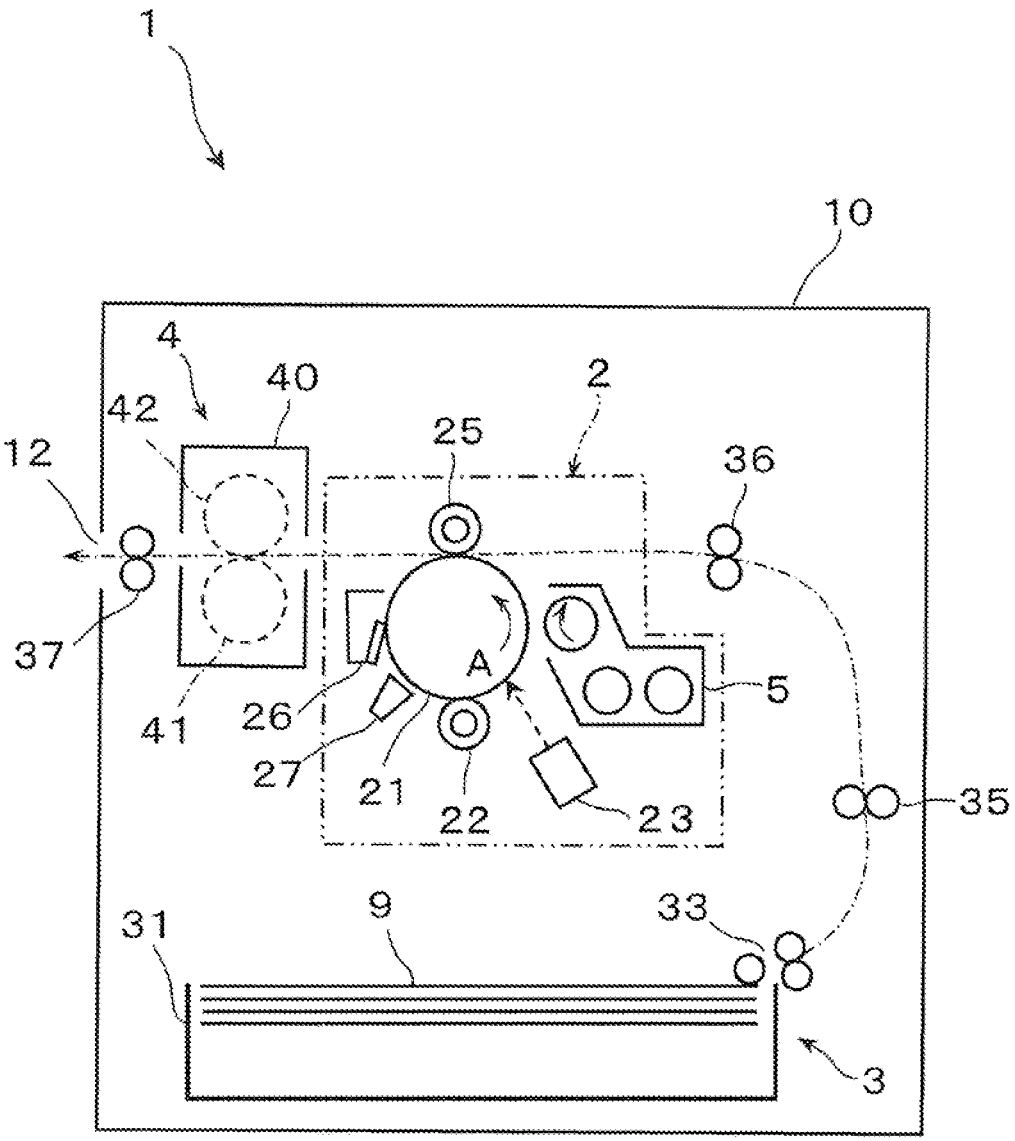
FIG. 1 is a schematic view illustrating an image forming apparatus according to a first exemplary embodiment.
Figure 2:
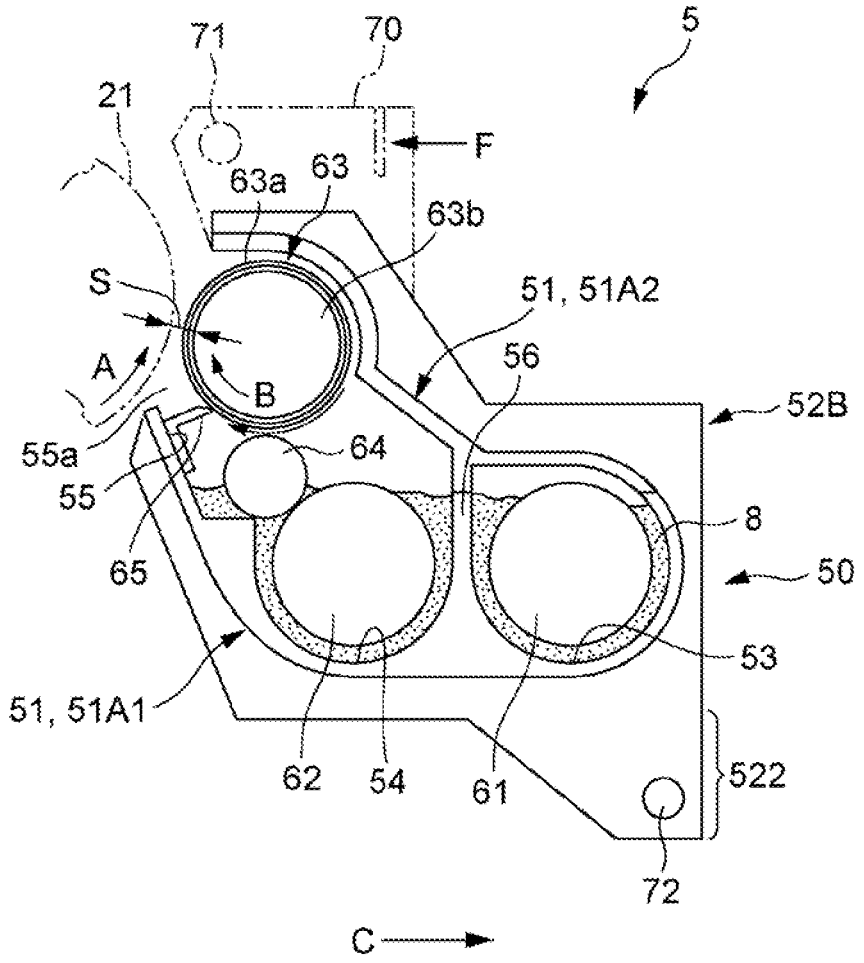
FIG. 2 is a schematic sectional view illustrating a developing device according to the first exemplary embodiment.

FIGS. 1 and 2 illustrate a first exemplary embodiment of the present disclosure. FIG. 1 illustrates an image forming apparatus 1 according to the first exemplary embodiment. FIG. 2 illustrates a developing device according to the first exemplary embodiment.

As illustrated in FIG. 1, the image forming apparatus 1 includes an image making device 2, a sheet feed device 3, a fixing device 4, and so forth disposed in a housing 10. The image making device 2 utilizes, for example, an electrophotographic method to form a toner image formed of toner as developer and transfer the formed image onto a sheet of recording paper 9 serving as an example of a recording material. The sheet feed device 3 supplies the required recording sheet 9 contained therein to a transfer position of the image making device 2. The fixing device 4 fixes the toner image having been transferred onto the recording sheet 9.

As illustrated in FIG. 1, the image making device 2 includes devices such as a charger 22, an exposure device 23, a developing device 5, a transfer device 25, a cleaner 26, and a static eliminator 27 disposed in this order around a photoconductor drum 21 to be rotated in a direction indicated by arrow A.

Among these, the photoconductor drum 21 is a photoconductor in the form of a drum and has a photosensitive layer on a circumferential surface thereof. In addition, the photoconductor drum 21 is rotatably supported by a support frame or the like (not illustrated) and receives power from a drive device (not illustrated) so as to be rotated in the arrow A direction. The charger 22 charges the circumferential surface of the photoconductor drum 21 (image forming region) to a required polarity and potential by using a charging member to which a charging bias is supplied.

The exposure device 23 radiates light corresponding to image information (signal) input to the image forming apparatus 1 by various methods to the charged circumferential surface of the photoconductor drum 21 so as to form an electrostatic latent image. The developing device 5 supplies the toner as the developer onto the photoconductor drum 21, thereby developing the electrostatic latent image on the photoconductor drum 21 so as to obtain a toner image. The details of the developing device 5 will be described later.

The transfer device 25 electrostatically transfers the toner image on the photoconductor drum 21 onto the recording sheet 9 by using a transfer member to which a transfer bias is supplied. The cleaner 26 cleans the circumferential surface of the photoconductor drum 21 by removing undesired substances such as toner adhering to and remaining on the circumferential surface of the photoconductor drum 21. The static eliminator 27 removes static charge from the circumferential surface of the photoconductor drum 21 having been cleaned.

The sheet feed device 3 includes, for example, sheet containers 31 and a feeding device 33. The sheet containers 31 each contains a plurality of recording sheets 9 of required size, type, and the like used for image forming such that the recording sheets 9 are stacked one on top of another in the sheet container 31. The feeding device 33 feeds the recording sheets 9 contained in the sheet containers 31 one sheet after another.

The sheet containers 31 are attached such that the sheet containers 31 are able to be kept drawn from the housing 10, and a plurality of the sheet containers 31 are provided corresponding to the form of use of the sheet containers 31. As the recording sheet 9, for example, a recording medium such as plain paper, coated paper, cardboard, or thin paper cut into a specified size is used.

The fixing device 4 includes fixing members such as a heating rotating body 41 and a pressure rotating body 42 in the form of a roller, a belt, or the like disposed in a housing 40 having an entrance opening and an exit opening for the recording sheet 9.

The heating rotating body 41 and the pressure rotating body 42 are supported so as to be rotated while in contact with each other. This contact portion serves as a fixing process portion that performs a required fixing process (heating, applying pressure, and so forth) while pinching the recording sheet 9 onto which the unfixed toner image has been transferred and allowing this recording sheet 9 to pass therethrough.

Image forming is performed by the image forming apparatus 1 as follows. Herein, the image forming is exemplified by a basic image forming operation for forming an image on one side of the recording sheet 9 for description.

Upon reception of a command (signal) requesting an image forming operation from an externally connected device by a controller (not illustrated) of the image forming apparatus 1, in the image making device 2, the photoconductor drum 21 starts to be rotated in the arrow A direction, the charger 22 charges the circumferential surface of the photoconductor drum 21 to the specified polarity (minus polarity in the present example) and potential, and then, the exposure device 23 radiates the light to the charged circumferential surface of the photoconductor drum 21 based on the image information having been input to the exposure device 23. Thus, the electrostatic latent image of a required pattern is formed.

Next, in the image making device 2, the developing device 5 supplies the toner charged to a required polarity (minus polarity in the present example) toward the electrostatic latent image formed on the circumferential surface of the photoconductor drum 21, thereby developing the electrostatic latent image to make the electrostatic latent image visible as the toner image. Thus, the toner image is formed on the photoconductor drum 21.

Then, in the image making device 2, the photoconductor drum 21 being rotated transports the toner image to the transfer position facing the transfer device 25.

Meanwhile, in the sheet feed device 3, the feeding device 33 feeds the recording sheet 9 to a supply transport path that includes transport rollers 35, 36, a sheet guide member, and the like, and at last, the recording sheet 9 is fed to the transfer position of the image making device 2 by the transport rollers 36 so as to be supplied in time for timing at which the toner image formed by the image making device 2 reaches the transfer position.

At the transfer position in the image making device 2 at this time, the transfer member of the transfer device 25 forms a transfer electric field between the transfer member and the photoconductor drum 21 so as to electrostatically transfer the toner image on the photoconductor drum 21 to one side of the recording sheet 9. Also in the image making device 2, during a time of the image forming operation including, for example, the time after this transference, the cleaner 26 continues to clean the circumferential surface of the photoconductor drum 21, and the static eliminator 27 removes the static charge from the photoconductor drum 21 having been cleaned. Thus, the photoconductor drum 21 is kept ready for an operating step of the next image forming.

Next, the recording sheet 9 onto which the toner image has been transferred is fed from the transfer position and transported toward the fixing device 4. In the fixing device 4, the recording sheet 9 is introduced into and caused to pass through the fixing process portion between the heating rotating body 41 and the pressure rotating body 42 being rotated. While the toner image is passing through the fixing process portion, the toner included in the toner image is heated under pressure so as to be fused, thereby the toner image on the one side of the recording sheet 9 is fixed to the recording sheet 9.

Furthermore, the fixing device 4 feeds the recording sheet 9 having undergone the fixing from the fixing process portion to an output transport path that includes output rollers 37, a sheet guide member, and the like. At last, the recording sheet 9 after the fixing is output through an output opening 12 of the housing 10 by the output rollers 37 in the output transport path so as to be contained in an output container portion (not illustrated).

Thus, a monochrome image including the toner of a single color has been formed on the one side of a single recording sheet 9, and the image forming operation for the one side of the recording sheet 9 is completed. When a command for execution of the image forming operation on a plurality of sheets is issued, the above-described series of operations are similarly repeated as many times as the number of the sheets.

Next, the developing device 5 is described.

Figure 3:
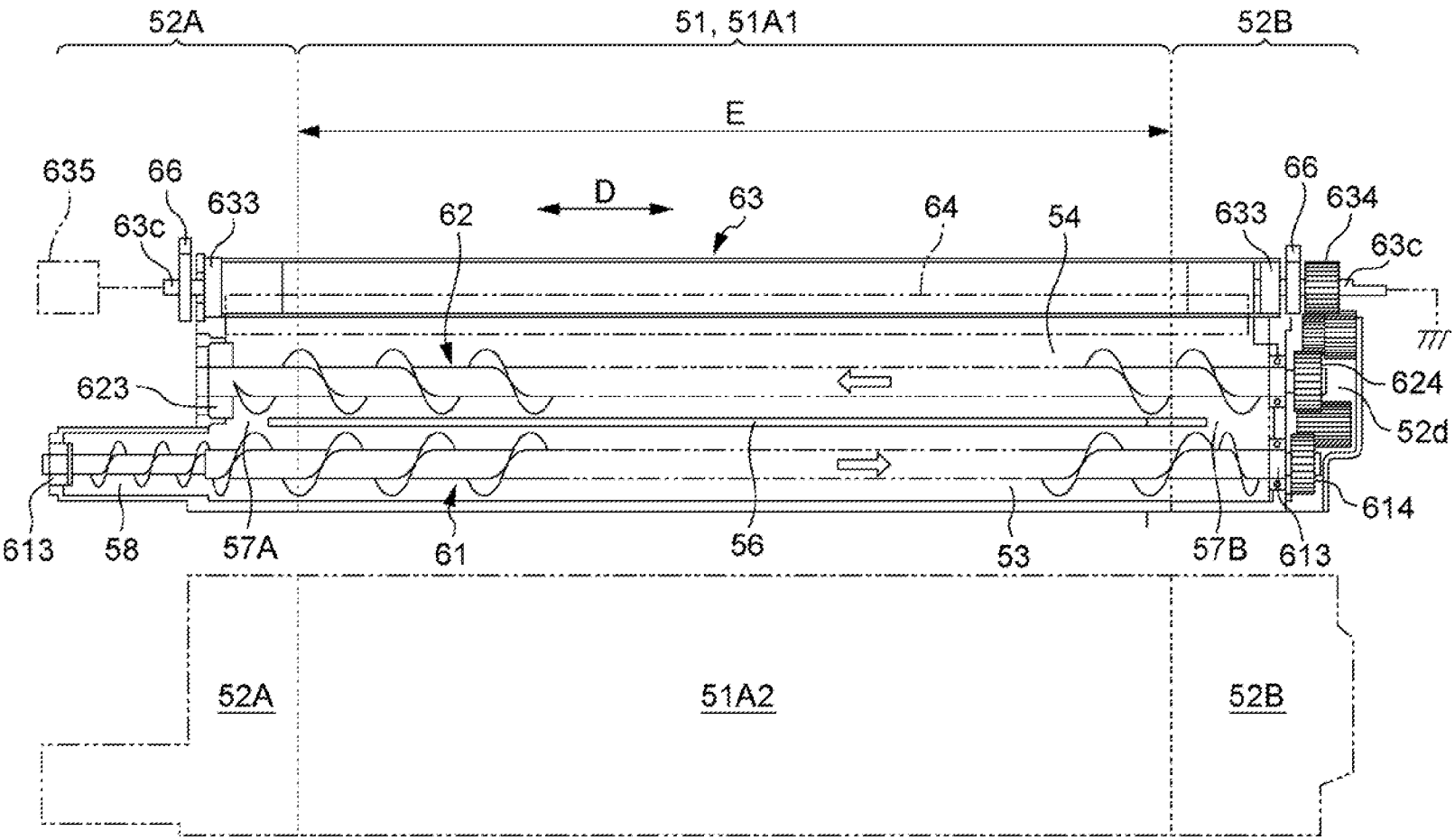
FIG. 3 is a top view illustrating part of the developing device illustrated in FIG. 2 (part of the developing device with an upper surface portion removed)

As illustrated in, for example, FIGS. 2 and 3, the developing device 5 includes a housing 50 that includes a container portion 51, transport members 61, 62, developing roller 63, a supply member 64, and a layer thickness adjusting member 65. The container portion 51 contains developer 8. The transport members 61, 62 rotate the developer 8 contained in the container portion 51 to transport the developer 8 in a longitudinal direction D. The transport members 61, 62 each serve as an example of a rotating portion 60. The developing roller 63 holds the developer 8 having been transported by the transport members 61, 62. The supply member 64 is rotated and supplies the developer 8 so as to pass the developer 8 from the container portion 51 to the developing roller 63. The supply member 64 serves as an example of the rotating portion 60. The layer thickness adjusting member 65 adjusts the thickness of a layer of the developer held by the developing roller 63.

The container portion 51 of the housing 50 is provided with two groove-shaped paths 53, 54 and a developing portion 55. The paths 53, 54 contain the developer 8. The paths 53, 54 are parallel to each other and each elongated in a single direction of its own in which the developer 8 is transported by a corresponding one of the transport members 61, 62. The developing portion 55 contains the developing roller 63 and has a developing opening 55*a* that allows part of the developing roller 63 to be exposed so as to face a developing target portion of the photoconductor drum 21.

Portions of two paths 53, 54 where the paths 53, 54 are adjacent to each other are kept separated by a separation wall 56 that extends in a longitudinal direction D. However, two paths 53, 54 are connected to each other through connecting portions 57A, 57B where the separation wall 56 is not provided at both end portions in the longitudinal direction D. Thus, the paths 53, 54 serve as a passage that allows transport of the developer 8 in a circulating manner. As the developer 8, for example, two-component developer that includes (non-magnetic) toner and (magnetic) carrier is used.

For example, a roller including a cylindrical (non-magnetic) sleeve 63*a* to be rotated in a direction indicated by arrow B and a magnet roller 63*b* disposed in a hollow space in the sleeve 63*a* is used for the developing roller 63. The developing roller 63 is rotatably supported by bearings 633 at a shaft portion 63*c* thereof.

A space S between the developing roller 63 and the photoconductor drum 21 is maintained at a fixed distance when space maintaining members 66 attached to the shaft portion 63*c* are partially kept in contact with portions that support the photoconductor drum 21. Furthermore, a developing bias is supplied from a power supply unit 635 to the shaft portion 63*c* of the developing roller 63 so as to form a developing electric field between the developing roller 63 and the photoconductor drum 21. For example, a direct current on which an alternating current component is superposed is supplied as the developing bias.

The supply member 64 is in the form of a paddle, a roller, or the like to be rotated and is rotatably supported by bearings (not illustrated) at a shaft portion thereof. The supply member 64 supplies toward the developing roller 63 part of the developer 8 moving through the path 54.

The transport members 61, 62 are, for example, screw augers having helical transport blades formed on a shaft portion and rotatably supported by bearings 613, 623 at the shaft portion. The transport members 61, 62 transport the developer 8 in the substantially axial directions while agitating the developer 8 when the transport members 61, 62 are rotated.

The layer thickness adjusting member 65 is a plate-shape member disposed in the axial direction of the developing roller 63 so as to be spaced from the developing roller 63 by a predetermined distance. The layer thickness adjusting member 65 scrapes off an excessive portion of a layer of the developer 8 held on the developing roller 63 into the container portion 51 to adjust the layer thickness.

Figure 4:
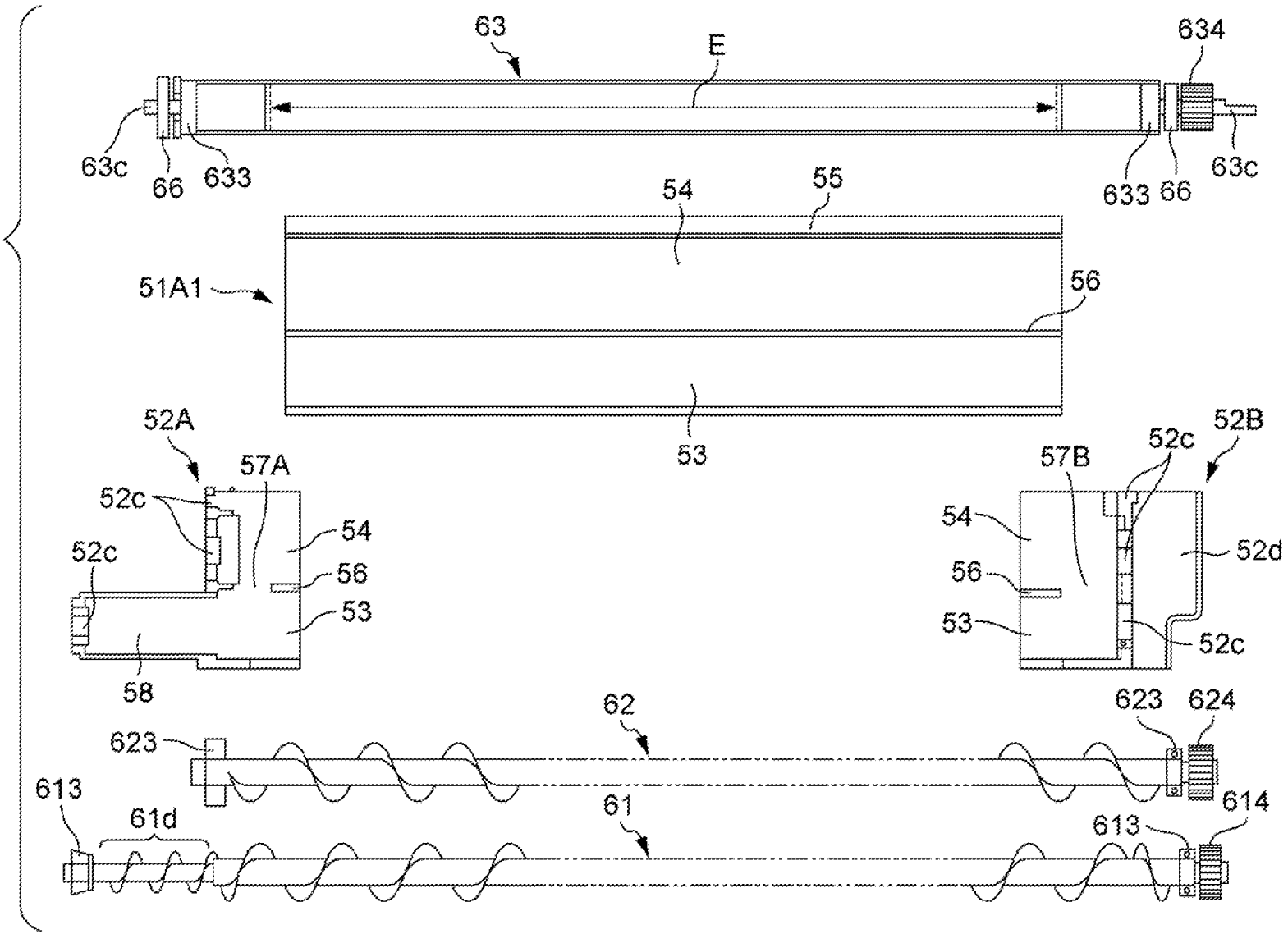
FIG. 4 is a schematic view illustrating the structure of parts of the developing device illustrated in FIG. 3 with the parts detached.

As illustrated in FIG. 3, the developing roller 63 has a region E in the longitudinal direction D where the developer 8 is held by the developing roller 63 (developer holding region). The container portion 51 of the housing 50 has a portion 51A superposed on the developer holding region E in the longitudinal direction D (may also be referred to as "superposed portion"). As illustrated in, for example, FIGS. 2, 4, and 5, the superposed portion 51A is divided into a lower superposed portion 51A1 and an upper superposed portion 51A2.

Figure 5:
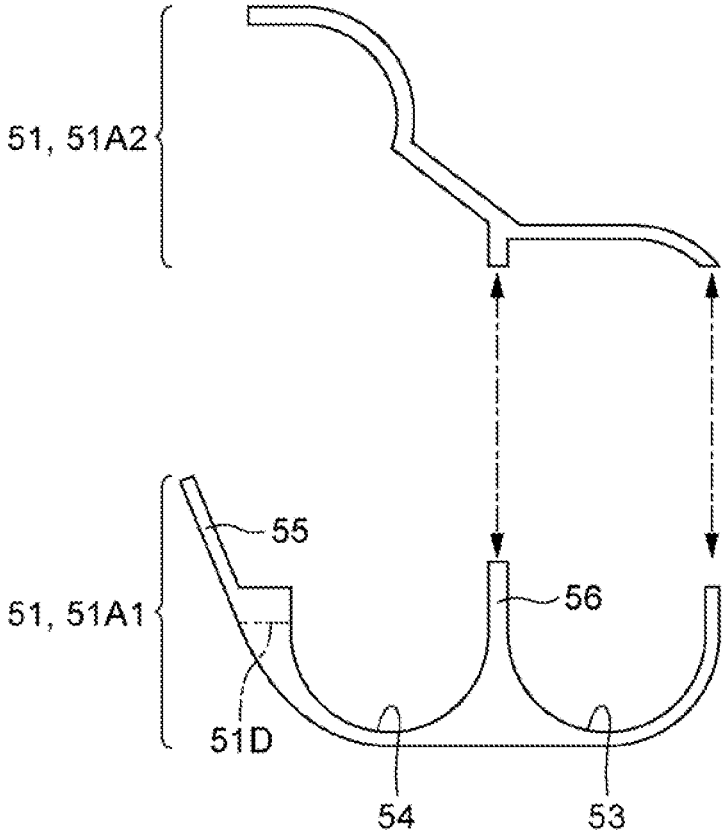
FIG. 5 is a schematic sectional view illustrating the structure of a container portion of a housing of the developing device illustrated in FIG. 2.

In this structure, as illustrated in FIGS. 2 and 5, the upper superposed portion 51A2 serves as a lid portion that substantially corresponds to a lid that covers parts of the paths 53, 54 and the developing portion 55 from above and is closed. In contrast, as illustrated in, for example, FIGS. 2, 5, and 6, the lower superposed portion 51A1 serves as a body portion that corresponds to a body that includes parts of the paths 53, 54 and the developing portion 55 except for upper end portions occupied by the superposed portion 51A2.

Furthermore, as illustrated in, for example, FIG. 3, the housing 50 has left and right support portions 52A, 52B joined to the superposed portions 51A1, 51A2 of the container portion 51 at respective end portions in the longitudinal direction D.

The left and right support portions 52A, 52B support, for example, the bearings 613, 623 of the transport members 61, 62, the bearings 633 of the developing roller 63, the shaft portion of the supply member 64 (not illustrated), and so forth. The support portions 52A, 52B, each of which is an integral structural portion without being separated in the up-down direction thereof, may be separated into two parts in the up-down direction thereof. However, when each of the support portions 52A, 52B is an integral structural portion, assembly work for joining and integrating two separated structural parts is not required during the assembly of the housing 50.

Furthermore, portions on sides of the support portions 52A, 52B joined to the container portion 51 are provided with the connecting portions 57A, 57B and the end portions of two paths 53, 54 except for parts of the paths 53, 54 in the superposed portions 51A1, 51A2. One of the support portions 52A has a replenishment path 58 that projects therefrom. The developer with which the developing device 5 is replenished is taken in the replenishment path 58 and fed to the path 53 through the replenishment path 58. The transport member 61 extends to form a replenishment transport portion 61*d*. The replenishment transport portion 61*d* includes a replenishment blade that transports to the path 53 the developer which also exists in the replenishment path 58 and with which the developing device 5 is replenished.

Furthermore, the support portions 52A, 52B have respective bearing attachment portions 52*c* (FIG. 4) on sides thereof opposite the container portion 51. The bearings 613, 623, 633, and the like are attached to the corresponding bearing attachment portions 52*c*. Furthermore, a drive transmission unit 52*d* is disposed further to the outer side than the bearing attachment portion 52*c* in one of the support portion 52B. A gear train mechanism that includes, for example, a gear 634 of the shaft portion 63*c* of the developing roller 63 and gears 614, 624 of the shaft portions of the transport members 61, 62 is disposed and contained in the drive transmission unit 52*d*.

Furthermore, as illustrated in FIG. 2, two movement support portions 71, 72 are provided in each of the support portions 52A, 52B. The movement support portions 71, 72 support the developing device 5 such that the developing device 5 is movable in a direction indicated by arrow C in which the developing device 5 is separated from the photoconductor drum 21.

The movement support portions 71, 72 are bar-shaped members that extend in the longitudinal direction of the developing device 5 (direction along the axial direction of the developing roller 63) at two positions, that is, the upper and lower positions of the developing device 5. The bar-shaped member of the upper movement support portion 71 is inserted through and secured at non-threaded holes respectively provided in left and right support plates 70 that are attached to outer surface portions of the support portions 52A, 52B so as to project upward. The bar-shaped member of the lower movement support portion 72 is inserted through and secured at non-threaded holes provided in lower protruding portions 522 that are formed to have a projecting shape in lower portions of the respective support portions 52A, 52B.

Wheels (not illustrated) are rotatably provided at both end portions of the bar-shaped member of each of the movement support portions 71, 72. The movement support portions 71, 72 are supported by support guide portions (not illustrated) that guide the wheels in the above-described direction C in which the developing device 5 is moved and support the wheels. The support guide portions are provided in, for example, parts of the housing 10. Pressing members (not illustrated) apply a pressing force F (FIG. 2) that acts in a direction in which the developing device 5 approaches the photoconductor drum 21 to, for example, parts of the support plates 70.

Here, in the developing device 5, when a required point of time of the image forming operation or the like has been reached, the transport members 61, 62, the developing roller 63, the supply member 64, and the like are rotated in predetermined directions by receiving rotating power from drive devices (not illustrated). In so doing, the developing bias is supplied to the developing roller 63.

Thus, in the paths 53, 54 of the container portion 51 of the housing 50, the developer 8 is agitated while transported in directions indicated by blank arrows in the longitudinal direction D of the paths 53, 54 by receiving transport forces by the transport members 61, 62 rotated in predetermined directions. At this time, the developer 8 is moved at the end side of the path 53 far from the developing roller 63 to the path 54 close to the developing roller 63 through the connecting portion 57B and moved at the end side of the path 54 to the path 53 through the connecting portion 57A. Consequently, as a whole, the developer 8 is transported so as to be circulated between the paths 53, 54 in the container portion 51.

Furthermore, in the developing portion 55 of the housing 50, the supply member 64 supplies part of the developer 8 transported through the path 54 so that the developing roller 63 holds the developer 8, the layer of the developer 8 held by the developing roller 63 is adjusted to a required thickness when passing thorough the layer thickness adjusting member 65, and then, the developing roller 63 transports the developer 8 so that the developer 8 passes through a developing target part that faces the photoconductor drum 21.

When the developer 8 passes through the developing target part, the developer 8 held by the developing roller 63 is moved to and adheres to the electrostatic latent image on the photoconductor drum 21 due to the developing electric field formed between the developing roller 63 and the photoconductor drum 21 by the developing bias. In this way, the electrostatic latent image is developed.

As illustrated in, for example, FIGS. 3 to 6, in this developing device 5, the lower superposed portion superposed portion 51A of the container portion 5151A1 of the superposed on the developer holding region E of the developing roller 63 is formed of metal throughout the superposed region.

For example, aluminum, from which the lower superposed portion 51A1 is easily produced by extrusion, is used as the metal. However, this is not limiting.

Figure 7A:
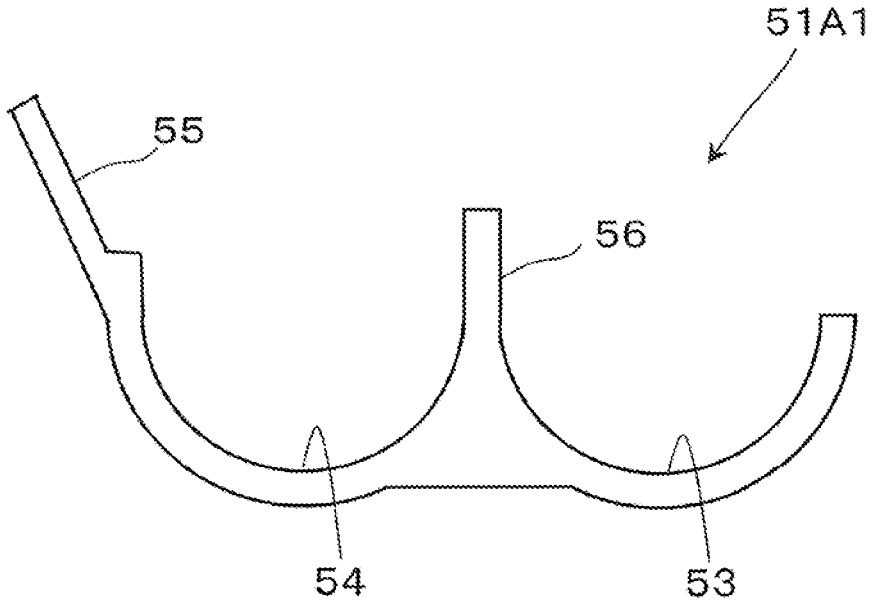
FIG. 7A is an explanatory view illustrating a sectional shape of a lower superposed portion that is part of the container portion illustrated in FIG. 6.

As illustrated in FIG. 7A, the lower superposed portion 51A1 formed of metal has a uniform shape in section perpendicular to the longitudinal direction D entirely in the longitudinal direction D.

The lower superposed portion 51A1 having such a sectional shape may be produced, for example, by employing extrusion or drawing for metal. When the sectional shape of the lower superposed portion 51A1 is not entirely uniform in the longitudinal direction D, the lower superposed portion 51A1 may be formed of metal by utilizing a forming method such as cutting.

In this developing device 5, the upper superposed portion 51A2 of the superposed portion 51A and the support portions 52A, 52B are formed of an electrically insulating material. In this developing device 5, the upper superposed portion 51A2 of the container portion 51 is also formed of an electrically insulating material.

Examples of the electrically insulating material include, for example, acrylonitrile butadiene styrene (ABS) resin, liquid crystal polymer, glass-containing resin, and the like. The performance of the electrical insulation at this time is to such a degree that there is no possibility of conducting the electricity of the developing bias supplied to the shaft portion 63*c* of the developing roller 63. When synthetic resin is used as the electrically insulating material, the upper superposed portion 51A2 and the support portions 52A, 52B are formed by utilizing a molding method for plastic.

Furthermore, in this developing device 5, the following structure is employed to connect the lower superposed portion 51A1 formed of metal and the support portions 52A, 52B formed of an electrically insulating material to each other.

Figure 8:
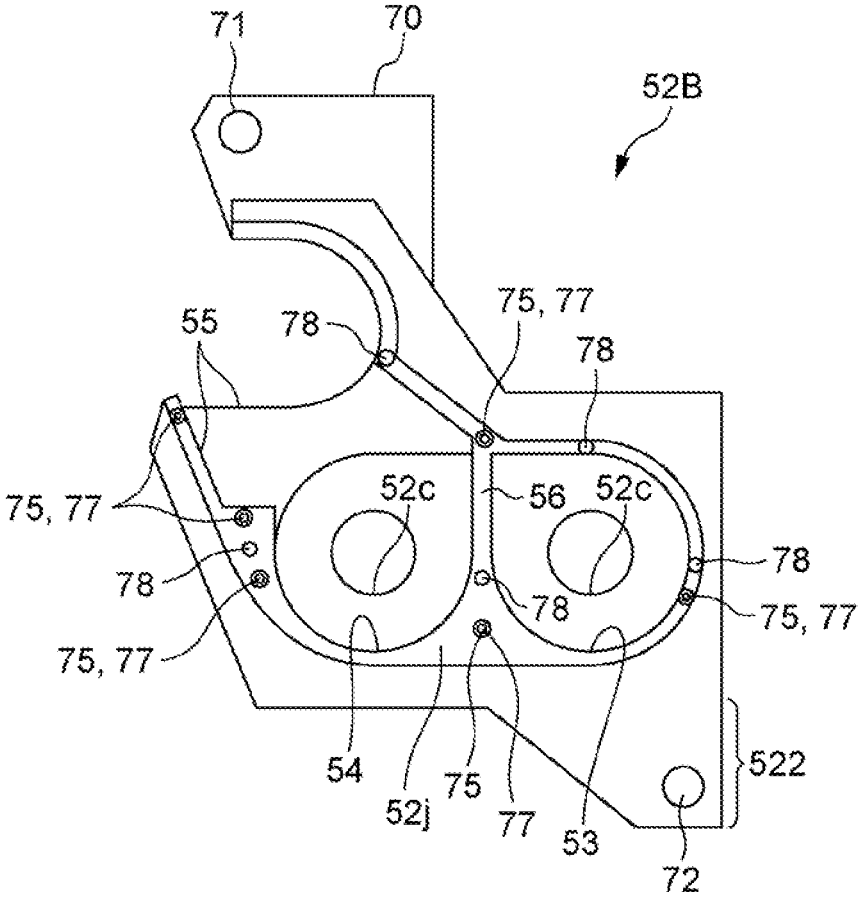
FIG. 8 is a schematic view illustrating one of support portions of the housing of the developing device illustrated in FIG. 2.

That is, the support portions 52A, 52B have respective joining surfaces 52*j* joined to the lower superposed portion 51A1, and, as illustrated in FIG. 8, a plurality of projections 75 to be in contact with joining surfaces 51*j* of the lower superposed portion 51A1 are provided on each of the joining surface 52*j*. For example, the projections 75 have a discoidal (or columnar) shape having a wished projecting amount h (see FIGS. 9A and 9B). A required number of the projections 75 are provided at wished positions.

Figure 7B:
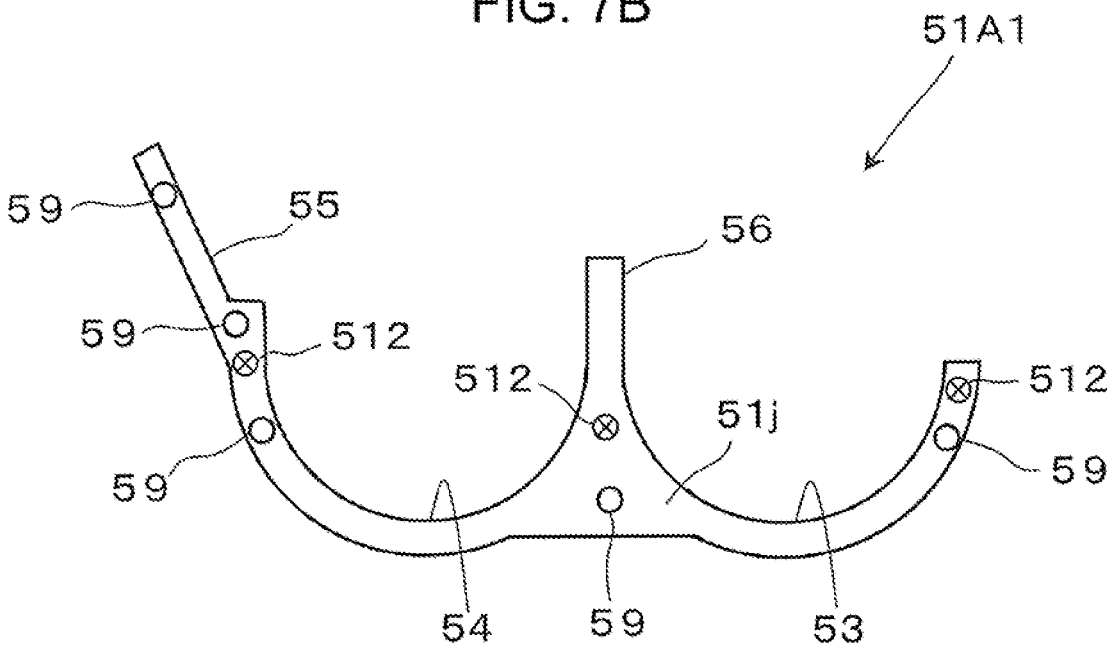
FIG. 7B is a schematic view illustrating the structure of a joining surface of the lower superposed portion.

Each of the projections 75 has a non-threaded hole 77 at the center. A screw 76 used for the connection to the lower superposed portion 51A1 is inserted through the non-threaded hole 77. In other words, the projection 75 in this case is provided in a portion surrounding the non-threaded hole 77 for a screw (and also around the screw 76). In contrast, as illustrated in FIG. 7B, threaded holes (internal threads) 59 to which the screws 76 are tightened are provided in the joining surfaces 51*j* of the lower superposed portion 51A1. The number and the positions of the threaded holes 59 correspond to those of the non-threaded holes 77.

Furthermore, as illustrated in FIG. 7B, a plurality of positioning protrusions 512 are provided in each of the joining surfaces 51*j* of the lower superposed portion 51A1. The positioning protrusions 512 are used to position the lower superposed portion 51A1 when the lower superposed portion 51A1 is joined to the support portions 52A, 52B. In contrast, as illustrated in FIG. 8, a plurality of positioning holes 78 are provided in the joining surface 52*j* of each of the support portions 52A, 52B. The positioning protrusions 512 are fitted into the respective positioning holes 78. The positioning protrusions 512 are provided, for example, as follows: securing holes (recesses) are provided in the joining surfaces 51*j* formed of metal; and then, members to serve as protrusions are press fitted into the securing holes.

Figure 9A:
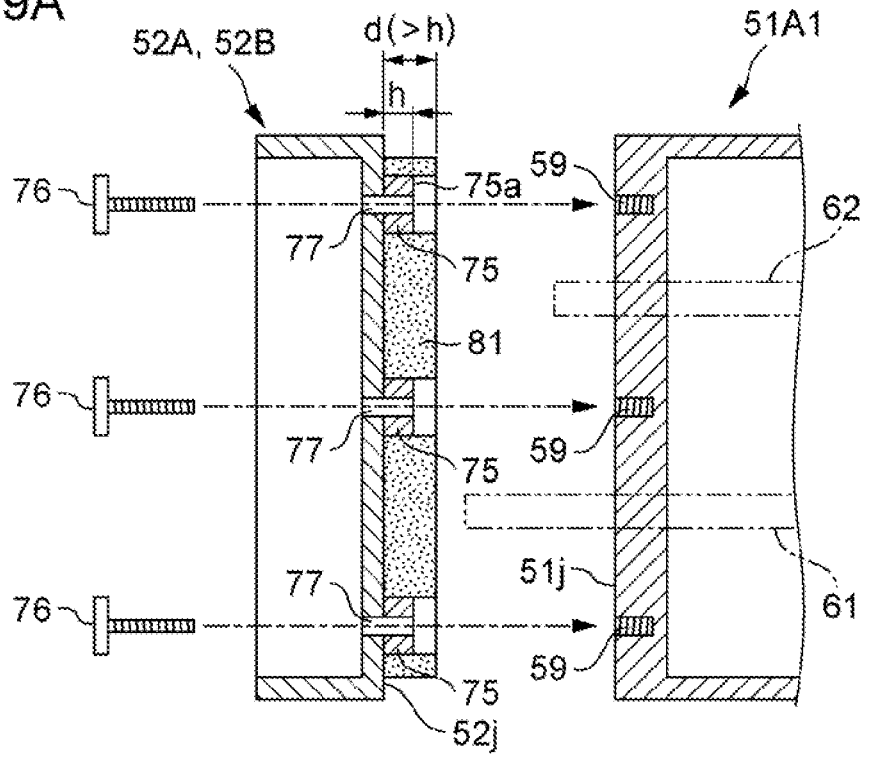
FIGS. 9A and 9B are schematic views illustrating a structure related to connection between the lower superposed portion and the support portion in the housing, and FIGS. 9A and 9B respectively schematically illustrate a pre-connection state and a connected state.
Figure 9B:
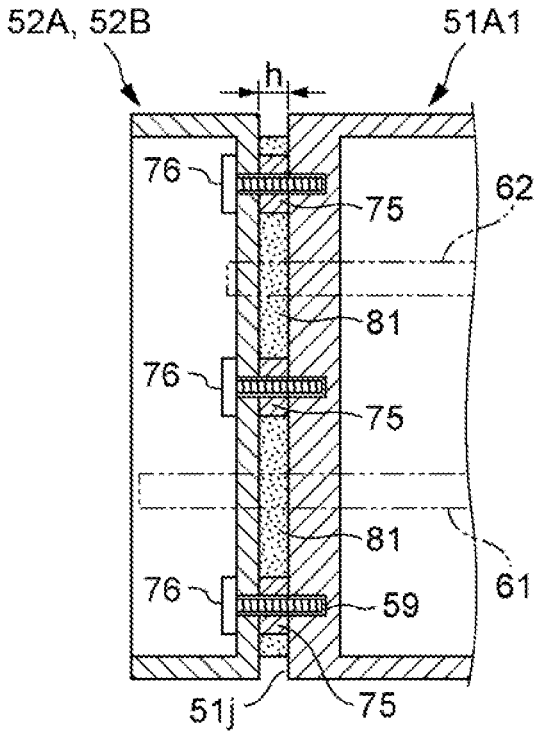

Furthermore, as schematically illustrated in FIGS. 9A and 9B, an elastic member 81 is attached to at least part of the joining surface 52*j* of each of the support portions 52A, 52B joined to the lower superposed portion 51A1.

One of the functions of the elastic members 81 is to suppress leakage of the developer 8 after the support portions 52A, 52B and the lower superposed portion 51A1 have been connected to each other, and the elastic members 81 are attached to at least regions where the leakage is required to be suppressed. It is sufficient that the elastic members 81 be formed of a material that itself deforms when the support portions 52A, 52B and the lower superposed portion 51A1 are connected to each other. For example, a member such as urethane sponge (or rubber) is applied. The elastic members 81 are attached to target parts of the joining surfaces of the support portions 52A, 52B by, for example, being bonded by an adhering material such as an adhesive or double-faced tape.

Furthermore, as illustrated in FIGS. 9A and 9B, the elastic members 81 to be attached have such a thickness d that exceeds the projecting amount h of the projections 75 (>h) before the support portions 52A, 52B and the lower superposed portion 51A1 are connected to each other. The thickness d is appropriately selected in view of physical properties and airtightness of the elastic members 81. Furthermore, as indicated by blanks in FIG. 9A, each of the elastic members 81 does not cover portions that cover projecting surfaces 75*a* of the projections 75. The elastic member 81 may cover the portions that cover the projecting surfaces 75*a* of the projections 75. However, when the elastic member 81 does not cover such portions, the projections 75 may be reliably brought into contact with the joining surfaces 51*j* of the lower superposed portion 51A1 so as to allow positioning to be performed during connection.

The lower superposed portion 51A1 and the support portions 52A, 52B are connected to each other as follows: the joining surfaces 51*j* and the joining surfaces 52*j* of the support portions 52A, 52B are moved close to each other as illustrated in FIG. 9A; and the screws 76 are inserted through the non-threaded holes 77 of the projections 75, and then, tighten to the threaded holes 59.

In the process of tightening the screws, the positioning protrusions 512 are fitted into the positioning holes 78, thereby the support portions 52A, 52B and the lower superposed portion 51A1 are positioned relative to each other. In addition, as illustrated in FIG. 9B, the support portions 52A, 52B and the lower superposed portion 51A1 are connected to each other in a state in which the projections 75 are in contact with the joining surfaces 51*j* of the lower superposed portion 51A1.

Also during the connection by tightening the screws, as illustrated in FIG. 9B, the elastic members 81 are brought into contact with the joining surfaces 51*j* of the lower superposed portion 51A1, and then, compressed due to elastic deformation so as to be set in a close contact state. As a result, due to compression of the elastic members 81, the thickness of the elastic members 81 when the connection is completed becomes equal to the projecting amount h of the projections 75.

Furthermore, in the developing device 5, the upper superposed portion 51A2 of the superposed portion 51A of the container portion 51 is joined to the lower superposed portion 51A1 and the support portions 52A, 52B by, for example, screws. Also for this connection, the projections 75 having the non-threaded holes 77 for screws, positioning protrusions 512, and the positioning holes 78 having been described may be similarly employed.

As described above, in the developing device 5 according to the first exemplary embodiment, the lower superposed portion 51A1 of the superposed portion 51A of the container portion 51 of the housing 50 is formed of metal. Thus, compared to the case where the container portion 51 of the housing 50 does not include metal, stiffness may be improved.

Accordingly, for example, even when the developing device 5 has a structure the size of which is entirely increased or in which the dimension of the developing device 5 in the longitudinal direction D is increased, a sufficient stiffness (strength) may be ensured against load applied to contain or hold the developer 8, the transport members 61, 62, and so forth. Thus, warpage or bending does not necessarily occur in the superposed portion 51A of the container portion 51 of the housing 50.

Furthermore, in the developing device 5, the support portions 52A, 52B are formed of an electrically insulating material. Accordingly, for example, even when the developing bias is supplied to the shaft portion 63*c* of the developing roller 63 during the image forming operation, electrical insulation of the support portions 52A, 52B that support the shaft portion 63*c* of the developing roller 63 may be ensured. Thus, electricity does not necessarily flow into the lower superposed portion 51A1 formed of the metal in the container portion 51.

Furthermore, in this developing device 5, the lower superposed portion 51A1 formed of metal and the support portions 52A, 52B formed of an electrically insulating material are connected to each other with the projections 75 interposed therebetween. Thus, compared to the case where no projection 75 is interposed (larger surface to larger surface connection), the lower superposed portion 51A1 and the support portions 52A, 52B may be more easily positioned relative to each other due to the projections 75 interposed therebetween and may be connected in a good state.

Furthermore, in this developing device 5, each of the projections 75 is provided in a portion surrounding the non-threaded hole 77 for the screw 76 or surrounding the screw 76 when the screw 76 is tightened. Thus, compared to the case where the projection 75 is not provided in a portion surrounding the non-threaded hole 77 or the tightened screw 76 (for example, the projection 75 is provided at a different position from the position where the screw 76 is tightened), the lower superposed portion 51A1 of the container portion 51 formed of metal and the support portions 52A, 52B may be more reliably positioned, and accordingly, firmly connected.

Furthermore, in this developing device 5, the lower superposed portion 51A1 and the support portions 52A, 52B are connected to each other with the elastic members 81, which have the thickness d that exceeds the projecting amount h of the projections 75 before the connection, interposed therebetween. Thus, compared to the case where the elastic members 81, which have a thickness d that does not exceed the projecting amount h of the projections 75 before the connection, is interposed for the connection, formation of a gap may be suppressed between the lower superposed portion 51A1 of the container portion 51 formed of metal and the surfaces in the support portions 52A, 52B joined to the lower superposed portion 51A1 with the elastic members 81 interposed therebetween. Accordingly, this developing device 5 may prevent most of leakage of the developer 8 through portions where the lower superposed portion 51A1 and the support portions 52A, 52B are connected to each other with the elastic members 81 interposed therebetween.

Other Exemplary Embodiments

In the above description, only the lower superposed portion 51A1 is formed of metal in the container portion 51 of the housing 50 of the developing device 5 according to the first exemplary embodiment. However, the upper superposed portion 51A2 of the container portion 51 may also be formed of metal.

In this case, compared to the case where only the lower superposed portion 51A1 is formed of metal, the stiffness of the developing device 5 may be further improved.

Figure 6:
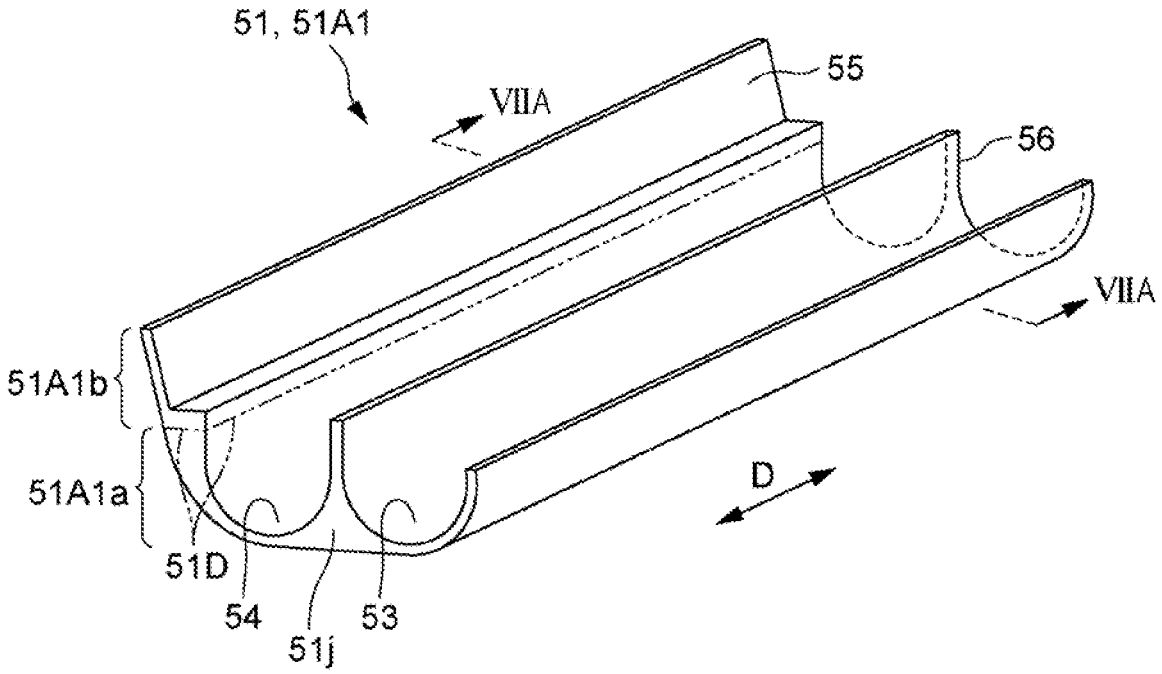
FIG. 6 is a schematic perspective view illustrating the structure of parts of the container portion illustrated in FIG. 5.

In the above description, the lower superposed portion 51A1 formed of metal is produced in a single operation by utilizing a forming method such as extrusion according to the first exemplary embodiment. However, as illustrated in FIG. 6, the lower superposed portion 51A1 formed of metal may be made by for example, connecting a plurality of parts separated at a plane (separation plane) 51D along the longitudinal direction D as a boundary. The lower superposed portion 51A1 exemplified in FIG. 6 includes two separated parts that are a first lower superposed portion 51A1*a* and a second lower superposed portion 51A1*b* separated at the plane 51D along the longitudinal direction D as the boundary.

In this case, compared to the case where the lower superposed portion 51A1 of the container portion 51 formed of metal is not separated into a plurality of parts, the lower superposed portion 51A1 may be more correctly produced.

In the above description, the projections 75 are provided on the joining surface 52*j* of the support portions 52A, 52B according to the first exemplary embodiment. However, the projections 75 may be provided on the joining surfaces 51*j* of the lower superposed portion 51A1 formed of metal. Furthermore, the projections 75 are not necessarily provided in the portions surrounding the screws 76 (or the non-threaded holes 77 for the screws 76) when the screws 76 are tightened state. The projections 75 may be provided at other positions than the portions surrounding the screws 76 or provided at different positions corresponding to the portions surrounding the screws 76.

According to the first exemplary embodiment, the left and right support portions 52A, 52B may be separated into, for example, first support portions that are respectively disposed on the left and right and that support the bearings 633 of the developing roller 63 and second support portions that are respectively disposed on the left and right and that support, for example, the bearings 613, 623 of the transport members 61, 62 and the shaft portion (not illustrated) of the supply member 64.

In this case, when the first support portions and the second support portions are formed of the same material (for example, an electrically insulating material), support portions that support not only the bearings 633 of the developing roller 63 but also the shaft portions of the rotating portions such as the transport members 61, 62 and the supply member 64 may be integrally formed. When such support portions are formed of an electrically insulating material, support portions that support not only the bearings 633 of the developing roller 63 but also the shaft portions of the rotating portions such as the transport members 61, 62 and the supply member 64 may be integrally formed, and electrical insulation may be ensured.

As the image forming apparatus 1 including the developing device 5, the image forming apparatus of a type forming monochrome images has been described as the example according to the first exemplary embodiment. However, as long as the developing device 5 according to the present disclosure is applicable, an image forming apparatus of, for example, a different type (for example, an image forming apparatus of a type forming multi-color images) may be employed.

In the case of an image forming apparatus that forms multi-color images, a plurality of developing devices required to reproduce colors of multi-color images are applied as the developing device 5. In this case, the transfer method of the image making device 2 is not limited to a direct transfer method. Instead, an intermediate transfer method (intermediate transfer device) may be employed.

Also, the developing device 5 to which the present disclosure is applied may be of another type as long as the developing roller 63 and the housing 50 including the container portion 51 are included.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A developing device comprising:

a housing that includes a container portion which has a metal formed portion formed of metal and which contains developer, a rotating portion to be rotated so as to transport the developer contained in the container portion in a longitudinal direction, and a developing roller which holds the developer transported by the rotating portion, wherein the metal formed portion is disposed in at least part of the container portion in a region superposed on a developer holding region of the developing roller in the longitudinal direction, and extends through a thickness direction of the housing from an internal portion contacting the developer to an external portion outside of the housing.

2. The developing device according to claim 1, wherein the developing roller has a first shaft portion, and the housing has a support portion that is joined to the container portion and that supports the first shaft portion, and wherein the support portion is formed of an electrically insulating material.

3. The developing device according to claim 2, wherein the rotating portion has a second shaft portion, and the housing has a second support portion that supports the second shaft portion, and wherein the second support portion is formed of an electrically insulating material and integral with the support portion that supports the first shaft portion.

4. The developing device according to claim 1, wherein
a sectional shape of the metal formed portion of the container portion is uniform in a direction perpendicular to the longitudinal direction.

5. The developing device according to claim 2, further comprising:
a screw, wherein
the rotating portion has a second shaft portion, and the housing has a second support portion that supports the second shaft portion, wherein
the metal formed portion of the container portion has a first joining surface, the support portion has a second joining surface, and the second support portion has a third joining surface, wherein
at least one of the first joining surface, the second joining surface, and the third joining surface has a projection, wherein
the metal formed portion and the support portion or the second support portion are connected to each other by using the screw, and wherein
when the metal formed portion and the support portion are connected to each other, the projection of the first joining surface is in contact with the second joining surface, or the projection of the second joining surface is in contact with the first joining surface, and
when the metal formed portion and the second support portion are connected to each other, the projection of the first joining surface is in contact with the third joining surface, or the projection of the third joining surface is in contact with the first joining surface.

6. The developing device according to claim 3, further comprising:
a screw, wherein
the metal formed portion of the container portion has a first joining surface, the support portion has a second joining surface, and the second support portion has a third joining surface, wherein
at least one of the first joining surface, the second joining surface, and the third joining surface has a projection, wherein
the metal formed portion and the support portion or the second support portion are connected to each other by using the screw, and wherein
when the metal formed portion and the support portion are connected to each other, the projection of the first joining surface is in contact with the second joining surface, or the projection of the second joining surface is in contact with the first joining surface, and
when the metal formed portion and the second support portion are connected to each other, the projection of the first joining surface is in contact with the third joining surface, or the projection of the third joining surface is in contact with the first joining surface.

7. The developing device according to claim 5, wherein
the second joining surface or the third joining surface has the projection.

8. The developing device according to claim 6, wherein
the second joining surface or the third joining surface has the projection.

9. The developing device according to claim 5, wherein
at least one of the first joining surface, the second joining surface, and the third joining surface has a first portion surrounding the screw, and wherein
the projection is provided at least in the first portion.

10. The developing device according to claim 6, wherein
at least one of the first joining surface, the second joining surface, and the third joining surface has a first portion surrounding the screw, and wherein
the projection is provided at least in the first portion.

11. The developing device according to claim 7, wherein
the second joining surface or the third joining surface has a first portion surrounding the screw, and wherein
the projection is provided at least in the first portion.

12. The developing device according to claim 8, wherein
the second joining surface or the third joining surface has a first portion surrounding the screw, and wherein
the projection is provided at least in the first portion.

13. The developing device according to claim 5, further comprising:
a first elastic member and a second elastic member, wherein
the metal formed portion of the container portion and the support portion are connected to each other, the metal formed portion of the container portion and the second support portion are connected to each other, the first joining surface is in contact with the second joining surface at least partially through the first elastic member interposed between the first joining surface and the second joining surface, and the first joining surface is in contact with the third joining surface at least partially through the second elastic member interposed between the first joining surface and the third joining surface, and wherein
a thickness of the first elastic member and a thickness of the second elastic member exceed a projecting amount of the projection before the metal formed portion and the support portion are connected to each other and the metal formed portion and the second support portion are connected to each other.

14. The developing device according to claim 6, further comprising:
a first elastic member and a second elastic member, wherein
the metal formed portion of the container portion and the support portion are connected to each other, the metal formed portion of the container portion and the second support portion are connected to each other, the first joining surface is in contact with the second joining surface at least partially through the first elastic member interposed between the first joining surface and the second joining surface, and the first joining surface is in contact with the third joining surface at least partially through the second elastic member interposed between the first joining surface and the third joining surface, and wherein
a thickness of the first elastic member and a thickness of the second elastic member exceed a projecting amount of the projection before the metal formed portion and the support portion are connected to each other and the metal formed portion and the second support portion are connected to each other.

15. The developing device according to claim 7, further comprising:
a first elastic member and a second elastic member, wherein
the metal formed portion of the container portion and the support portion are connected to each other, the metal formed portion of the container portion and the second support portion are connected to each other, the first joining surface is in contact with the second joining surface at least partially through the first elastic member interposed between the first joining surface and the second joining surface, and the first joining surface is in contact with the third joining surface at least partially through the second elastic member interposed between the first joining surface and the third joining surface, and wherein a thickness of the first elastic member and a thickness of the second elastic member exceed a projecting amount of the projection before the metal formed portion and the support portion are connected to each other and the metal formed portion and the second support portion are connected to each other.

16. The developing device according to claim 8, further comprising:

a first elastic member and a second elastic member, wherein the metal formed portion of the container portion and the support portion are connected to each other, the metal formed portion of the container portion and the second support portion are connected to each other, the first joining surface is in contact with the second joining surface at least partially through the first elastic member interposed between the first joining surface and the second joining surface, and the first joining surface is in contact with the third joining surface at least partially through the second elastic member interposed between the first joining surface and the third joining surface, and wherein a thickness of the first elastic member and a thickness of the second elastic member exceed a projecting amount of the projection before the metal formed portion and the support portion are connected to each other and the metal formed portion and the second support portion are connected to each other.

17. The developing device according to claim 9, further comprising:

a first elastic member and a second elastic member, wherein the metal formed portion of the container portion and the support portion are connected to each other, the metal formed portion of the container portion and the second support portion are connected to each other, the first joining surface is in contact with the second joining surface at least partially through the first elastic member interposed between the first joining surface and the second joining surface, and the first joining surface is in contact with the third joining surface at least partially through the second elastic member interposed between the first joining surface and the third joining surface, and wherein a thickness of the first elastic member and a thickness of the second elastic member exceed a projecting amount of the projection before the metal formed portion and the support portion are connected to each other and the metal formed portion and the second support portion are connected to each other.

18. The developing device according to claim 13, wherein the first elastic member and the second elastic member are attached to the second joining surface and the third joining surface.

19. The developing device according to claim 4, wherein the metal formed portion of the container portion is made by connecting a plurality of separated parts separated at a plane along the longitudinal direction as a boundary.

20. An image forming apparatus comprising:

the developing device according to claim 1.

* * * * *